US007928054B2

(12) United States Patent
Gould

(10) Patent No.: US 7,928,054 B2
(45) Date of Patent: Apr. 19, 2011

(54) DETERGENT ADDITIVE EXTRUDATES CONTAINING ALKYL BENZENE SULPHONATE

(75) Inventor: Paul Anthony Gould, Stockport (GB)

(73) Assignee: The Procter & Gamble Company, Cincinnati, OH (US)

( * ) Notice: Subject to any disclaimer, the term of this patent is extended or adjusted under 35 U.S.C. 154(b) by 205 days.

(21) Appl. No.: 12/152,487

(22) Filed: May 15, 2008

(65) Prior Publication Data

US 2008/0287339 A1 Nov. 20, 2008

Related U.S. Application Data

(60) Provisional application No. 60/930,550, filed on May 17, 2007.

(51) Int. Cl.
*C11D 17/00* (2006.01)

(52) U.S. Cl. ..... 510/451; 510/452; 510/453; 510/454; 510/446

(58) Field of Classification Search ..... None
See application file for complete search history.

(56) References Cited

U.S. PATENT DOCUMENTS

| | | | | |
|---|---|---|---|---|
| 2,220,099 | A | | 11/1940 | Heidelberg et al. |
| 2,477,383 | A | | 7/1949 | Lewis |
| 4,228,042 | A | | 10/1980 | Letton |
| 4,239,660 | A | | 12/1980 | Kingry |
| 4,260,529 | A | | 4/1981 | Letton |
| 4,637,891 | A | | 1/1987 | Delwel et al. |
| 4,726,908 | A | | 2/1988 | Kruse et al. |
| 5,133,924 | A | | 7/1992 | Appel et al. |
| 5,160,657 | A | | 11/1992 | Bortolotti et al. |
| 5,164,108 | A | | 11/1992 | Appel et al. |
| 5,569,645 | A | | 10/1996 | Dinniwell et al. |
| 6,004,922 | A | | 12/1999 | Watson et al. |
| 6,022,844 | A | | 2/2000 | Baillely et al. |
| 6,034,050 | A | * | 3/2000 | Artiga Gonzalez et al. .. 510/451 |
| 6,114,297 | A | | 9/2000 | Yamaguchi et al. |
| 6,136,769 | A | | 10/2000 | Asano et al. |
| 6,221,825 | B1 | | 4/2001 | Williams, Jr. et al. |
| 2007/0042932 | A1 | | 2/2007 | Appleby et al. |

FOREIGN PATENT DOCUMENTS

| | | |
|---|---|---|
| EP | 66915 | 11/1987 |
| WO | WO98/35002 | 8/1998 |
| WO | WO98/35003 | 8/1998 |
| WO | WO98/35004 | 8/1998 |
| WO | WO98/35005 | 8/1998 |
| WO | WO98/35006 | 8/1998 |
| WO | WO 00/18873 A | 4/2000 |
| WO | WO 00/37595 A1 | 6/2000 |
| WO | WO 2005/083049 A | 9/2005 |

OTHER PUBLICATIONS

PCT International Search Report Dated Sep. 5, 2008—5 pgs.

* cited by examiner

*Primary Examiner* — Necholus Ogden, Jr.
(74) *Attorney, Agent, or Firm* — Julie A. McConihay; Leonard W. Lewis; Steven W. Miller

(57) ABSTRACT

A detergent additive extrudate containing from about 0.5% to about 20% an alkyl benzene sulphonate, from about 0.5% to about 15% a water soluble carboxylate-containing polymer, from about 20% to about 80% water soluble inorganic salt and a moisture level of 2% to 10%; process for making the detergent additive extrudate and granular laundry detergent containing the same. The detergent additive extrudates have an improved physical stability, dissolution property and ease of process property.

8 Claims, No Drawings

DETERGENT ADDITIVE EXTRUDATES CONTAINING ALKYL BENZENE SULPHONATE

CROSS REFERENCE TO RELATED APPLICATION

This application claims the benefit of U.S. Provisional Application No. 60/930,550, filed May 17, 2007.

FIELD OF THE INVENTION

The present invention relates to detergent additive extrudates containing alkyl benzene sulphonate, process for making the same and compositions containing the same. In particular, the present invention relates to detergent additive extrudates having improved physical stability, dissolution property and ease of processing property with an overall low cost.

BACKGROUND OF THE INVENTION

Detergent additive extrudates are used in granular detergent compositions as carriers for certain additive components and/or to impart an aesthetic appeal to the granular detergent compositions are well known. Such detergent additive extrudates can be provided in the form of "noodles". As used herein, the term "noodles" is used to refer to generally cylindrical particles prepared by extruding a paste through the holes of the die plate of an extruder and followed by cutting the extrudates into pieces of desirable length. So far, it has been a challenge to prepare detergent additive extrudates containing alkyl benzene sulphonate having satisfactory physical stability, rate of dissolution and ease of processing with an overall low cost, due to the sticky nature of alkyl benzene sulphonate and various other considerations a formulator needs to balance in such an effort. For example, from ease of processing standpoint, the formula paste of the detergent additive extrudates should be sufficiently plastic to be extruded satisfactorily through the holes of extruders, but not so soft and sticky that may cause the extrudates to stick together, bend or swell. On the other hand, the extrudates should not be so hard and brittle as to need to use costly, high power extrusion equipments and should not tend to break up into undesirable small pieces.

Some references have suggested using high level of soap as a major ingredient of detergent additive noodles. However, they recognize that water solubility and rate of dissolution of such noodles will become another concern as soap usually does not have an acceptable solubility in tepid water. Other known formulations and processes for detergent additive extrudates require either specialty materials to meet the physical properties of the extrudates and/or costly extrusion equipments of technically complex, thus the overall cost of the extrudates is high.

Accordingly, there is still a need for detergent additive extrudates containing alkyl benzene sulphonate having improved physical stability, dissolution property and ease of processing property with an overall low cost.

SUMMARY OF THE INVENTION

Inventors of the present invention, through extensive researches and experiments, have found an optimized formula of detergent additive extrudates meeting the above needs. Specifically, the detergent additive extrudates herein contains from about 0.5% to about 20% by weight of an alkyl benzene sulphonate, from about 0.5% to about 15% of a water soluble carboxylate-containing polymer and from about 10% to about 80% of water soluble inorganic salt, wherein the moisture level in the detergent additive extrudates is from about 2% to 10% and the detergent additive extrudate has an average lateral dimension in the range of from about 0.25 millimeters to about 2 millimeters, and an average longitudinal dimension in the range from about 2 to about 20 millimeters. It has been found that the detergent additive extrudate herein has an improved physical stability and rate of dissolution in water. In addition, the lump of the detergent additive extrudates before extrusion has an optimized viscosity which allows the utilization of technically less complicated, low power extrusion equipments, as a result, the overall cost of the detergent additive extrudate herein is low.

In another aspect of the present invention, the detergent additive extrudate herein further contains from about 0.5% to about 20% by weight of an alkali metal salt of C8-C20 fatty acid. Without intending to be bound by theory, it is believed that the alkali metal salt of C8-C20 fatty acid in the detergent additive extrudates herein further strengthens the extrudates, smoothes the extrudate appearance and lubricates the extrusion equipments in processing.

In still another aspect of the present invention, a granular detergent composition containing from about 0.1% to about 10% of the detergent additive extrudates herein is provided.

In still another aspect of the present invention, a process for making the detergent additive extrudates is provided. The process herein includes the steps of:

(i) mixing all the ingredients in a mixer to form a substantially homogeneous lump;

(ii) extruding the homogeneous lump through the die plate holes of an extrusion equipment to from wet strand;

(iii) drying the wet strand; and (iv) breaking the wet strand into pieces with specified length;

wherein said die plate holes have an average diameter of from about 0.25 mm to about 2 mm.

DETAILED DESCRIPTION OF THE INVENTION

As used herein, the term "water soluble" means that a component is soluble or otherwise dispersible (such as to provide a micellar solution) in water at a level of at least about 0.25 percent by weight at 25 degrees Centigrade under ambient condition.

Unless otherwise specified, all ratios, percentages and parts herein are on a weight basis. All ratios, percentages and parts relating to components in the detergent additive extrudates are based on the total weight of the detergent additive extrudates, unless otherwise specified. All ratios, percentages and parts relating to other components in the granular detergent compositions are based on the total weight of the granular detergent compositions, unless otherwise specified.

Alkyl Benzene Sulphonate

The detergent additive extrudate herein contains from about 0.5% to about 20%, or from about 1% to about 10% of an alkyl benzene sulphonate. In the detergent additive extrudate, in addition to performing as a cleaning active ingredient, the alkyl benzene sulphonates also plays the function of binding components together. Suitable alkyl benzene sulphonate useful herein can comprise any of those typically used in liquid and/or solid detergent products. Exemplary alkyl benzene sulphonates are the alkali metal salts of C10-16 alkyl benzene sulfonic acids. Preferably the alkyl group is linear and such linear alkyl benzene sulphonates are known as "LAS". Alkyl benzene sulphonates, and particularly LAS, are well known in the art. Such surfactants and their preparation are described for example in U.S. Pat. Nos. 2,220,099 and 2,477,383. Especially preferred are the sodium and potassium linear straight chain alkylbenzene sulphonates in which the average number of carbon atoms in the alkyl group is from about 11 to 14. Sodium C11-C14, LAS is a specific example of alkyl benzene sulphonate.

In a non-limiting specifically preferred embodiment herein, the detergent additive extrudates contain from about 2% to about 10% of sodium C12 linear alkyl benzene sulphonate.

Water Soluble Carboxylate-containing Polymer

The detergent additive extrudate herein contains from about 0.5% to about 15%, or from about 1% to about 10% of a water soluble carboxylate-containing polymer. Without intending to be bound by theory, it is believed that the water soluble carboxylate-containing polymer useful herein binds the dry solid raw materials together as it becomes thick and sticky in wet and becomes a solid after drying, and thus improves the physical stability of the detergent additive extrudates. In addition, presence of the water soluble carboxylate-containing polymers improves the rate of dissolution of the detergent additive extrudates.

By "carboxylate-containing polymer" it is meant herein a polymer or copolymer containing at least a monomeric unit which contains at least a carboxylate functionality, such as homo- or co-polymeric polycarboxylic acids or their salts. Such carboxylate-containing polymers can be prepared by polymerizing or copolymerizing suitable unsaturated monomers, preferably in their acid form. Unsaturated monomeric acids that can be polymerized to form suitable water soluble carboxylate-containing polymers herein include acrylic acid, maleic acid (or maleic anhydride), fumaric acid, itaconic acid, aconitic acid, mesaconic acid, citraconic acid and methylenemalonic acid. The water soluble carboxylate-containing polymers herein may also contain monomeric segments containing no carboxylate radicals, such as vinylmethyl ether, styrene, ethylene, etc.

Particularly suitable water soluble carboxylate-containing polymers herein can be derived from acrylic acid. Such acrylic acid-based polymers which are useful herein are the water-soluble salts of polymerized acrylic acid. The average molecular weight of such polymers in the acid form preferably ranges from about 2,000 to 1,000,000, or from about 10,000 to 150,000, or from about 20,000 to 100,000. Water-soluble salts of such acrylic acid polymers can include, for example, the alkali metal, ammonium and substituted ammonium salts. Soluble polymers of this type are known materials. Acrylic acid/maleic acid-based copolymers may also be used as a preferred water soluble carboxylate-containing polymer. Such materials include the water-soluble salts of copolymers of acrylic acid and maleic acid. The average molecular weight of such copolymers in the acid form preferably ranges from about 2,000 to 100,000, or from about 5,000 to 75,000, or from about 7,000 to 65,000. The ratio of acrylate to maleate segments in such copolymers will generally range from about 30:1 to about 1:1, or from about 10:1 to 2:1. Water-soluble salts of such acrylic acid/maleic acid copolymers can include, for example, the alkali metal, ammonium and substituted ammonium salts. Suitable acrylate/maleate copolymers of this type are known materials which are described in European Patent Application No. 66915, published Dec. 15, 1982. Particularly preferred is a copolymer of maleic/acrylic acid with an average molecular weight of about 70,000. Such copolymers are commercially available from BASF under the trade name SOKALAN CP5. Other suitable water soluble carboxylate-containing polymers to be used herein include cellulose derivatives such as carboxymethylcellulose (CMC). Preferably, the CMC polymer has a weight average molecular weight of between 20,000 and 500,000, or between 100,000 and 300,000, or between 150,000 and 250,000 and has an average degree of carboxymethyl substitution (DS) of between 0.3 and 0.9, or between 0.4 and 0.8, or between 0.45 and 0.7. Carboxymethylcellulose may be used as a salt with conventional cations such as sodium, potassium, amines or substituted amines. Examples of suitable CMC polymers are Finnfix BDA (Noviant), Tylose CR1500 G2 (Clariant), Carbose codes D65, D72, LT-30 and LT-20 (Penn Carbose).

Water Soluble Inorganic Salt

The detergent additive extrudates herein contain from about 20% to about 80%, one or more water soluble inorganic salts. The water soluble inorganic salt herein acts as a support material and stabilizer.

Water soluble inorganic salts useful herein include, but are not limited to, the alkali metal salts of phosphates (exemplified by the polyphosphates, pyrophosphates, and glassy polymeric meta-phosphates, silicates, carbonates (including bicarbonates), sulphates and aluminosilicates. In one embodiment herein, the detergent additive extrudates contain from about 20% to about 40% of alkali metal carbonate and from about 20% to about 40% alkali metal sulfate.

Alkali Metal Salt of Fatty Acid

In a preferred embodiment, the detergent additive extrudates further contain from about 0.5% to about 20%, or from about 1% to about 10% of an alkali metal salt of a fatty acid having from about 8 to about 20 carbon atoms, i.e. an alkali metal salt of C8-C20 fatty acid. The alkali metal salt of C8-C20 fatty acid is believed to further strengthen the physical stability of the extrudates, smoothes the extrudate appearance and lubricates the extrusion equipments.

The alkali metal salt of C8-C20 fatty acid suitable for use herein includes those typically used in soap bars. An alkali metal salt of C8-C20 fatty acid, particularly those derived from mixtures of coconut and tallow oils are preferred. Alkali metal salt of C8-C20 fatty acid made from other fats can also be used as will be evident to those skilled in the art. The fatty acid herein normally contains from 8 to 20, preferably from about 12 to about 18 carbon atoms. Commercial alkali metal salts of C8-C20 fatty acid preferred herein are generally based upon mixtures of fatty acids obtained from various natural sources. Coconut oil, tallow and palm oil stearin are useful sources of the alkali metal salt of C8-C20 fatty acid useful herein. Other suitable sources include palm kernel oil and babassu kernel oil which are included within the term "coconut oil", olive oil and synthetic fatty acids, for example, tallow. Particularly useful alkali metal salt of C8-C20 fatty acid herein is the sodium and potassium salts of mixtures of fatty acids derived from coconut oil, palm kernel oil, tallow and/or palm oil stearin, e.g., sodium or potassium tallow and coconut oils. Preferred alkali metal salt of C8-C20 fatty acid mixtures are the tallow/(coconut or palm kernel oil) sodium salt ranging in proportions from 80:20 to 50:50 by weight. These mixtures are preferred from the standpoint of water solubility, ready availability, ease of processing and their desirably performance characteristics.

Other Surfactants

Besides alkyl benzene sulphonate described above, the detergent additive extrudates may further contain one or more non-soap surfactants typically used in liquid or solid detergents, such as alkyl sulfate, ethoxylated alkyl sulfate, nonionic surfactant, cationic surfactant, etc. Ethoxylated alkyl sulfate surfactants, also known as alkyl ether sulfates or alkyl polyethoxylate sulfates, are those which correspond to the formula: R'—O—$(C2H_4O)_n$—$SO_3M$ wherein R' is a C8-C20 alkyl group, n is from about 1 to 20, and M is a salt-forming cation.

Suitable nonionic surfactants useful herein can comprise any of the conventional nonionic surfactant types typically used in liquid and/or solid detergent products. These include alkoxylated fatty alcohols and amine oxide surfactants. Suitable alcohol alkoxylate nonionic surfactants useful herein may correspond to the general formula: $R1(C_mH_{2m}O)_nOH$, wherein R1 is a C8-C16 alkyl group, m is from 2 to 4, and n ranges from about 2 to 12. Another suitable type of nonionic surfactant useful herein comprises the amine oxide surfactants. Amine oxides are materials which are often referred to in the art as "semi-polar" nonionics. Amine oxides have the formula: $R(EO)x(PO)y(BO)zN(O)(CH_2R')2.qH_2O$. In this formula, R is a relatively long-chain hydrocarbyl moiety which can be saturated or unsaturated, linear or branched, and can contain from 8 to 20, or from 10 to 16 carbon atoms. R' is a short-chain moiety, preferably selected from hydrogen, methyl and —$CH_2OH$. When x+y+z is different from 0, EO is ethyleneoxy, PO is propyleneneoxy and BO is butyleneoxy. Amine oxide surfactants are illustrated by C12-14 alkyldimethyl amine oxide.

Cationic surfactants are well known in the art and non-limiting examples of these include quaternary ammonium surfactants, which can have up to 26 carbon atoms. Additional examples include a) alkoxylate quaternary ammonium (AQA) surfactants as discussed in U.S. Pat. No. 6,136,769; b) dimethyl hydroxyethyl quaternary ammonium as discussed in U.S. Pat. No. 6,004,922; c) polyamine cationic surfactants as discussed in WO 98/35002, WO 98/35003, WO 98/35004, WO 98/35005, and WO 98/35006; d) cationic ester surfactants as discussed in U.S. Pat. Nos. 4,228,042, 4,239,660 4,260,529 and 6,022,844; and e) amino surfactants as discussed in U.S. Pat. No. 6,221,825 and WO 00/47708, specifically amido propyldimethyl amine (APA).

Other Ingredients

The detergent additive extrudates herein may comprise a variety of other ingredients typically used in laundry detergents. These include conventional laundry detergent composition components, such as dyestuff, detersive builders, enzymes, enzyme stabilizers (such as propylene glycol, boric acid and/or borax), suds suppressors, soil suspending agents, soil release agents, other fabric care benefit agents, pH adjusting agents, chelating agents, smectite clays, solvents, hydrotropes and phase stabilizers, structuring agents, optical brighteners and perfumes. The various optional detergent composition ingredients, if present in the compositions herein, should be utilized at concentrations conventionally employed to bring about their desired contribution to the composition or the laundering operation. Frequently, the total amount of such optional ingredients can range from about 0.01% to about 50%, more preferably from about 1% to about 30%, by weight of the detergent additive extrudates.

In a specific preferred embodiment, the detergent additive extrudates is coloured and a dyestuff is mixed with other components to produce the detergent additive extrudates. Preferred colours are blue, green and pink, and examples of suitable dyestuffs include Monastral Green BNV, Ultramarine Blue, and mixtures of Ultramarine Blue with yellow pigments. Dyestuffs may suitably be present in the detergent additive extrudates in an amount of up to 0.5%, or from 0.01 to 0.4% by weight.

Moisture Level

The detergent additive extrudates herein has a moisture level of from about 2% to about 10%, or from about 4% to about 7%. It has been surprisingly found that moisture level in the detergent additive extrudates herein is critical in ensuring the extrudates to have the desired physical stability and rate of dissolution. Specifically, when the moisture level is lower than 2%, the extrudates will become crispy and tend to break up into undesirable small pieces. On the other hand, although a higher moisture level may lead to a better physical stability, a moisture level higher than 10% will dramatically deteriorate the rate of dissolution of the detergent additive extrudates and the physical stability during storage and shipment of the detergent additive extrudates which tends to cake together.

Moistures in the detergent additive extrudates may come from raw materials for making the detergent additive extrudates, if desired, additional water may be added at the mixing step. The moisture level in the detergent additive extrudates can be determined by measuring the weight loss of a given amount of detergent additive extrudates after drying them in an oven at 160° C. for 2 hours.

Process for Making the Detergent Additive Extrudates

The detergent additive extrudates herein can be made by a process including the steps of:

(i) mixing all the ingredients in a mixer to form a substantially homogeneous lump;

(ii) extruding the lump through the die plate holes of an extrusion equipment to form wet strands;

(iii) drying the wet strands; and (iv) breaking wet strands into pieces with specified length;

wherein said die plate holes have an average diameter of from about 0.25 mm to about 2 mm.

By "homogeneous", it means that the mixture of all the starting materials prior to extrusion has a moist, uniform texture so that extrudates obtained from the mixture have an even quality. Various mixer, extrusion equipment and drying equipment known in the art can be used herein. Exemplary mixers useful herein include ribbon blenders, paddle mixers, rotary mixers, concrete mixers, etc. High shear batch rotary mixers with chopper blades which blend and disperse materials simultaneously are preferred. Such type of mixer is commonly used in blending powder and liquid materials and well known in the art. Typical extrusion equipments are single or twin screw extruders that work predominantly in axial direction for extrusion but can also work horizontally depending on the rate requirements of the process. In addition to the conventional extrusion equipments, technically less complicated, lower power extrusion equipment can be used herein as the optimized formula of the detergent additive extrudates herein allows the utilization of such low-cost extrusion equipments, such as a single screw extruder supplied by Fuji Paudal Co. Ltd. In a non-limiting embodiment, the extrusion equipment useful herein is an extruder with a length/diameter ratio of from 2 to 40 and with a power of from 2 kw to 150 kw The substantially homogeneous lump is extruded through an apertured screen of an extrusion equipment to form wet strands having an average lateral dimension in the range of from about 250 microns to about 2 millimeters, or from about 600 microns to about 900 microns. The wet strands are then dried by a common drying process, such as drying on a rotary drier, belt drier, forced air drier or fluid bed drier, or weather drying and are allowed to break into pieces of desirable length. After drying, the moisture level of the detergent additive extrudates should be reduced from about 10-30% to about 2-10%. In a non-limiting embodiment herein, upon drying, the elongate extrudate breaks into detergent additive extrudates having an average longitudinal dimension in the range of from 2 millimeters to about 20 millimeters, or from about 3 millimeters to about 10 millimeters, or from about 4 millimeters to about 9 millimeters.

Preferably, the laundry detergent additive extrudates herein have an average longitudinal: lateral dimension ratio of from about 1:1 to about 13:1, or from 3:1 to about 10:1. In this context, "average" refers to a simple number-average.

Granular Detergent Compositions

The present invention further provides granular detergent compositions containing the detergent additive extrudates described herein. Preferred granular detergent compositions comprise from about 0.1% to about 10%, or from about 0.5% to about 3% of the detergent additive extrudates. In addition to the detergent additive extrudates, the granular detergent compositions herein may contain from about 5% to about 40% of a surfactants commonly used in the granular detergent field, such as those described above with respect to the surfactant component in the detergent additive extrudates. The granular detergent compositions herein may also contain from about 10% to about 60% by weight of one or more detergency builders. Detergency builders are well known to those skilled in the art and include sodium tripolyphosphate, orthophosphate and pyrophosphate; crystalline and amorphous sodium aluminosilicate; sodium carbonate; and monomeric and polymeric polycarboxylates, for example, sodium citrate, polyacrylate and acrylic copolymers. Other inorganic salts for example, sodium silicate or sodium sulphate, may also be included in the granular detergent compositions herein. The granular detergent compositions may also generally contain various additives to enhance the efficiency of the product, notably bleach systems, antiredeposition agents, fluorescers, lather suppressors, enzymes and perfumes.

The granular detergent compositions herein can be made by simply mixing the detergent additive extrudates with the base powder of the granular detergent composition. The base powder of the granular detergent composition can be made by any suitable process known in the art, such as a standard spray-drying process or agglomeration process. Typical spray-drying process or agglomeration process known in the art can be used in preparing the base powder. By way of example, see the processes described in U.S. Pat. No. 5,133,924, issued Jul. 28, 1992; U.S. Pat. No. 4,637,891, issued Jan. 20, 1987; U.S. Pat. No. 4,726,908, issued Feb. 23, 1988; U.S. Pat. No. 5,160,657, issued Nov. 3, 1992; U.S. Pat. No. 5,164,108, issued Nov. 17, 1992; U.S. Pat. No. 5,569,645, issued Oct. 29, 1996.

The base powder is then charged into a mixer. The detergent additive extrudates and any other dry-added materials as well as sprayed-on materials are added into the mixer by a known process. A suitable mixer useful for this process can be a continuous cylindrical drum or equipments marketed under the tradename FORBERG™ and the mixer can be operated in a normal manner.

Test Method

Attrition Value

Weigh out 10 grams of detergent additive extrudates and put them into a vertical tube with a diameter of about 3 cm and length of at least about 80 cm. The bottom of the tube has an aperture having a diameter of 0.2 mm. High pressure air is pumped through the aperture with an air volume of about 7 liters/min. The detergent additive extrudates are then continually blew up and fall down. After 10 minutes of air-blowing, take all the detergent additive extrudates out and sieve the sample with a sieve having a pore size of 150 microns for 5 minutes. The attrition value is the percentage of the amount of extrudate in grams passing through the sieve to the weight of original sample (10 grams).

Rate of Dissolution Value

Weigh out 10 grams of detergent additive extrudate and put them into a flask containing 1000 ml de-ionised water. The solution has a set temperature of 20° C. during the whole testing period. Keep stirring the solution with a blender at 200 RPM. Measure the conductivity of the solution by a Sartorius, PP-50 conductivity meter every 30 seconds until the detergent additive extrudates are fully dissolved in the solution and the conductivity of the solution reaches a constant. Draw a calibration curve of the conductivity value versus time in seconds. The time when the solution reaches its 95% conductivity is recorded as the rate of dissolution value (ROD Value) of the tested detergent additive extrudate.

EXAMPLES

Noodle premix lumps are made by mixing components according to the lump formula shown in the following Table 1 in a Food mixer (food processor, type K600, supplied by Bolang Germany) for about 5 minutes. Once the mixture reaches a substantially homogeneous state, extrude the lump through the die plate of an extruder (single screw, radial lab top extruder, L/D=3, Power=790 W, type MG-55, supplied by Fuji Paudal Co. Ltd.) with 0.8 mm round holes in diameter to obtain wet strands which are dried by a pre-heated oven (80° C.) to reach the specified final moisture level. Formulas of the finished detergent additive extrudates of the Examples and Comparative Examples are shown in Table 2. The detergent additive extrudates of Example 1 and 2 have an average longitudinal dimension of about 8 mm and a lateral dimension of about 0.8 mm.

TABLE 1

Lump Formula

| Ingredients | Example 1 | Example 2 | Comparative Example 1 | Comparative Example 2 |
|---|---|---|---|---|
| LAS surfactant paste[1] | 5 g | 5 g | | 5 g |
| AS surfactant paste[2] | | | 35 g | |
| CMC[3] | 8 g | | | |
| Acrylic acid/maleic acid copolymer[4] | | 8 g | | |
| Soap[5] | 2 g | | | |
| Sodium Carbonate | 42 g | 35 g | 32 g | 47 g |
| Sodium Sulfate | 42 g | 35 g | 32 g | 47 g |
| Dye | 0.4 g | 0.4 g | 0.4 g | 0.4 g |

[1]LAS surfactant paste contains 45% of C12-C16 linear alkyl benzene sulphonate (C12-C16 LAS) and 55% of water

[2]AS surfactant paste contains 73% coco fatty alcohol sulfate and 27% water

[3]Sodium salt of carboxymethyl cellulose having a weight average molecular weight of about 200,000

[4]The acrylic acid/maleic acid copolymer has a weight average molecular weight of about 70,000

[5]Soap contains about 80% C16 fatty acid sodium salt, the rest is sodium sulfate and water.

TABLE 2

Detergent additive extrudates formula

| Ingredients | Example 1 | Example 2 | Comparative Example 1 | Comparative Example 2 |
|---|---|---|---|---|
| C12-C16 LAS | 2.2% | 2.2% | | 2.2% |
| Coco fatty alcohol sulfate | | | 25% | |
| CMC | 8% | | | |
| acrylic acid/maleic acid copolymer | | 8% | | |
| Sodium Palmate soap | 2% | | | |
| Sodium | 42% | 42% | 32% | 47% |

TABLE 2-continued

| Detergent additive extrudates formula | | | | |
|---|---|---|---|---|
| Ingredients | Example 1 | Example 2 | Comparative Example 1 | Comparative Example 2 |
| Carbonate | | | | |
| Sodium Sulfate | 42% | 42% | 32% | 47% |
| Dye | 0.2% | | 0.1% | |
| Moisture level | 3.6% | 4.3% | 8.2% | 3.3% |
| | | Balance to 100 | | |

Attrition value and Rate of Dissolution (ROD) value of the detergent additive extrudates prepared in the above Examples and Comparative Examples are tested according to the test method described above. The test results are shown in the following Table 3. As can be seen in the data, detergent additive extrudate of the present invention have less undesirable breakage than detergent additive extrudate of Comparative Examples. In addition, detergent additive extrudates of the present invention have an acceptable rate of dissolution.

TABLE 3

| | Example 1 | Example 2 | Comparative Example 1 | Comparative Example 2 |
|---|---|---|---|---|
| Average Attrition Value | 13.50% | 13.75% | 45.53% | 100% (very bad) |
| ROD Value (seconds) | 260 | 240 | 400 | 120 |

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

All documents cited in the Detailed Description of the Invention are, in relevant part, incorporated herein by reference; the citation of any document is not to be construed as an admission that it is prior art with respect to the present invention. To the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A detergent additive extrudate comprising:

(a) from about 0.5% to about 20% an alkyl benzene sulphonate;

(b) from about 0.5% to about 15% a water soluble carboxylate-containing polymer;

(c) from about 20% to about 80% water soluble inorganic salt;

wherein the moisture level of said detergent additive extrudate is from about 4% to about 7%, and wherein said detergent additive extrudate has an average lateral dimension of from about 0.25 millimeters to about 2 millimeters, and an average longitudinal dimension of from about 2 to about 20 millimeters.

2. The detergent additive extrudate of claim 1, further containing from about 0.5% to about 20% an alkali metal salt of a fatty acid having an alkyl chain containing from about 8 to about 20 carbon atoms.

3. The detergent additive extrudate of claim 1, wherein said water soluble carboxylate-containing polymer is selected from the group consisting of a polyacrylic acid, an acrylic acid/maleic acid copolymer, a carboxymethyl cellulose and a mixture thereof.

4. The detergent additive extrudate of claim 3, wherein said water soluble carboxylate-containing polymer is carboxymethyl cellulose having a weight average molecular weight of from about 100,000 to about 300,000.

5. The detergent additive extrudate of claim 1, further comprising from about 0.01% to about 1% of a dye.

6. A process for making the detergent additive extrudate of claim 1, comprising the steps of:

(i) mixing all the ingredients in a mixer to form a substantially homogeneous lump;

(ii) extruding the homogeneous lump through the die plate holes of an extrusion equipment to from wet strands;

(iii) drying the wet strands; and (iv) breaking the wet strands into pieces of a specified length;

wherein said die plate holes have an average diameter of from about 0.25 mm to about 2 mm.

7. The process of claim 6, wherein said extrusion equipment has a length/diameter ratio of from about 2 to about 40 and a power of from about 2 kw to about 150 kw.

8. A granular laundry detergent composition, comprising from about 0.1% to about 10% of the detergent additive extrudate of claim 1.

* * * * *